US007753354B2

(12) United States Patent
Baba et al.

(10) Patent No.: US 7,753,354 B2
(45) Date of Patent: Jul. 13, 2010

(54) SHEET POSTPROCESSING APPARATUS AND SHEET POSTPROCESSING METHOD

(75) Inventors: Kazuaki Baba, Tokyo (JP); Atsushi Kurabayashi, Tokyo (JP); Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 622 days.

(21) Appl. No.: 11/659,796

(22) PCT Filed: Aug. 12, 2005

(86) PCT No.: PCT/JP2005/014840

§ 371 (c)(1),
(2), (4) Date: Aug. 29, 2007

(87) PCT Pub. No.: WO2006/016675

PCT Pub. Date: Feb. 16, 2006

(65) Prior Publication Data

US 2008/0075559 A1 Mar. 27, 2008

(30) Foreign Application Priority Data

Aug. 12, 2004 (JP) ..... 2004-235639

(51) Int. Cl.
*B65H 37/04* (2006.01)

(52) U.S. Cl. ..... 270/58.09; 270/58.07; 270/58.08; 270/58.11; 270/58.12; 270/58.17; 270/58.27

(58) Field of Classification Search ..... 270/58.07, 270/58.08, 58.09, 58.11, 58.12, 58.17, 58.27; 412/11, 13, 14

See application file for complete search history.

(56) References Cited

U.S. PATENT DOCUMENTS

| | | | | |
|---|---|---|---|---|
| 4,537,545 | A * | 8/1985 | Kunzmann | 412/7 |
| 2006/0263173 | A1* | 11/2006 | Yoshie | 412/6 |
| 2007/0122255 | A1* | 5/2007 | Trovinger et al. | 412/33 |
| 2007/0166130 | A1* | 7/2007 | Kurabayashi et al. | 412/38 |
| 2008/0253820 | A1* | 10/2008 | Baba et al. | 399/410 |
| 2009/0148216 | A1* | 6/2009 | Odani | 399/410 |

FOREIGN PATENT DOCUMENTS

| | | | |
|---|---|---|---|
| JP | 6-115277 | A | 4/1994 |
| JP | 6-335895 | A | 12/1994 |
| JP | 2001-185599 | A | 7/2001 |
| JP | 2003-160273 | A | 6/2003 |
| JP | 2003-320780 | A | 11/2003 |

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

There is provided a sensor 48 for detecting penetration of a sheet by a punch hole aligning pin 42, and there is provided controlling means for retrying a penetrating operation by returning the punch hole aligning pin to an initial position when a time period from starting to move the pin to penetrating the sheet exceeds a reference time period. Even when a degree of unalignment of the punch hole of the sheet P is considerable and the punch hole aligning pin cannot penetrate through the sheet by once, the punch hole aligning pin is penetrated therethrough frequently by repeating the penetrating operation and therefore, an error in aligning the sheet can be reduced. In a case in which the pin is not penetrated through the sheet even when the penetrating operation is carried out by a predetermined number of times, the pin is returned to the initial position and an error is displayed.

10 Claims, 13 Drawing Sheets

SHEET POSTPROCESSING APPARATUS AND SHEET POSTPROCESSING METHOD

TECHNICAL FIELD

The present invention relates to a sheet postprocessing apparatus and a sheet postprocessing method having a function of aligning punch holes of a bundle of sheets attached with the punch holes.

BACKGROUND ART

There is a sheet postprocessing apparatus for carrying out a staple binding processing or a processing of mounting a binder or the like for sheets subjected to a processing of copying, forming punch holes or the like. JP-A-2003-160273 discloses a sheet postprocessing apparatus for carrying out a processing of binding staples by accurately aligning punch holes of a bundle of sheets attached with the punch holes. According to the sheet postprocessing apparatus of JP-A-2003-160273, the bundle of sheets attached with the punch holes are positioned to align by a reference of the punch hole by inserting a pin into the hole bored at the sheets and the staple binding processing is carried out in a state of inserting the pin thereto.

When the sheets attached with the punch holes are aligned by the reference of the punch hole by inserting the pin driven by a motor, a solenoid or the like through the punch hole of the sheets attached with the punch holes, when a positional shift of the punch hole of the sheets is large, there is a case in which the pin cannot penetrate through the punch hole, a pin drive mechanism is stopped in the midst of a stroke to bring about an error. Particularly, when a number of the sheets is large, or a thick sheet is loaded as a cover, a load of sliding the pin and the punch hole relative to each other is large and therefore, there is a high possibility of bringing about the above-described error.

When the motor, the solenoid or the like is made to be strong such that the pin drive mechanism is not stopped in the midst of the stroke, a problem of large-sized formation of the apparatus or an increase in cost is posed, or there can be brought about a case in which the pin penetrates through the punch hole in a state of shifting the position of the punch hole to deform the punch hole or bring about a crack.

DISCLOSURE OF THE INVENTION

According to one or more embodiments of the invention, in a constitution of aligning a sheet attached with a punch hole by a reference of the punch hole, a concern of an error in aligning the sheet is resolved.

According to one or more embodiments of the invention, sheet postprocessing apparatus is provided with a sheet table, a pin capable of penetrating through a punch hole of a sheet taken in onto the sheet table, a sheet penetration detecting apparatus for detecting penetration of the pin through the sheet, and a counter for measuring a time period of driving the pin.

According to one or more embodiments of the invention, the sheet postprocessing apparatus is further provided with a control portion for retrying a penetrating operation by returning the pin to an initial position when the time period of driving the pin reaches a reference time period for penetrating through the sheet.

According to one or more embodiments of the invention, the sheet postprocessing apparatus is further provided with a trial number of times setting portion for setting a trial number of times of the pin. The control portion returns the pin to the initial position to display an error when the trial number of times reaches a set number of times and when the time period of driving the pin reaches the reference time period before penetrating the sheet in a final trial.

According to one or more embodiments of the invention, the sheet postprocessing apparatus is further provided with controlling means for proceeding to a sheet discharge mode without carrying out a postprocessing of a bind processing by a staple, a binder mounting processing or the like at the time of the error.

According to one or more embodiments of the invention, the sheet postprocessing apparatus is further provided with a pivotable lever. The pin is moved between an initial position and a sheet penetrating position in accordance with pivoting the lever. The sheet penetration detecting apparatus comprises a first optical sensor and a second optical sensor. When the pin is disposed at the initial position, the lever blocks an optical path of the first optical sensor, and when the pin is disposed at the sheet penetrating position, the lever blocks an optical path of the second optical sensor.

According to one or more embodiments of the invention, the sheet postprocessing apparatus is further provided with a binder mounting processing.

According to one or more embodiments of the invention, a sheet postprocessing method is provided with the steps of taking in a sheet formed with a punch hole for binding onto a sheet table sheet by sheet, loading one set of the sheets onto the sheet table, driving a pin to a punch hole of the sheet taken in onto the sheet table, measuring a time period of driving the pin, comparing the time period of driving the pin with a reference time period, retrying a penetrating operation by returning the pin to an initial position when the time period of driving the pin reaches the reference time period for penetrating the sheet, penetrating the pin to the punch hole of the sheet taken in onto the sheet table, and aligning the sheets by a reference of the punch hole.

According to one or more embodiments of the invention, the sheet postprocessing method is further provided with the step of carrying out binder mounting processing.

According to one or more embodiments of the invention, the sheet postprocessing method is further provided with the steps of measuring a trial number of times of the pin, and displaying an error when the trial number of times reaches a predetermined number of times and when the time period of driving the pin reaches the reference time period before penetrating the sheet in a final trial.

Other aspects and advantages of the invention will be apparent from the following description and the appended claims.

DESCRIPTION OF REFERENCE NUMERALS AND SIGNS

Figure 1:
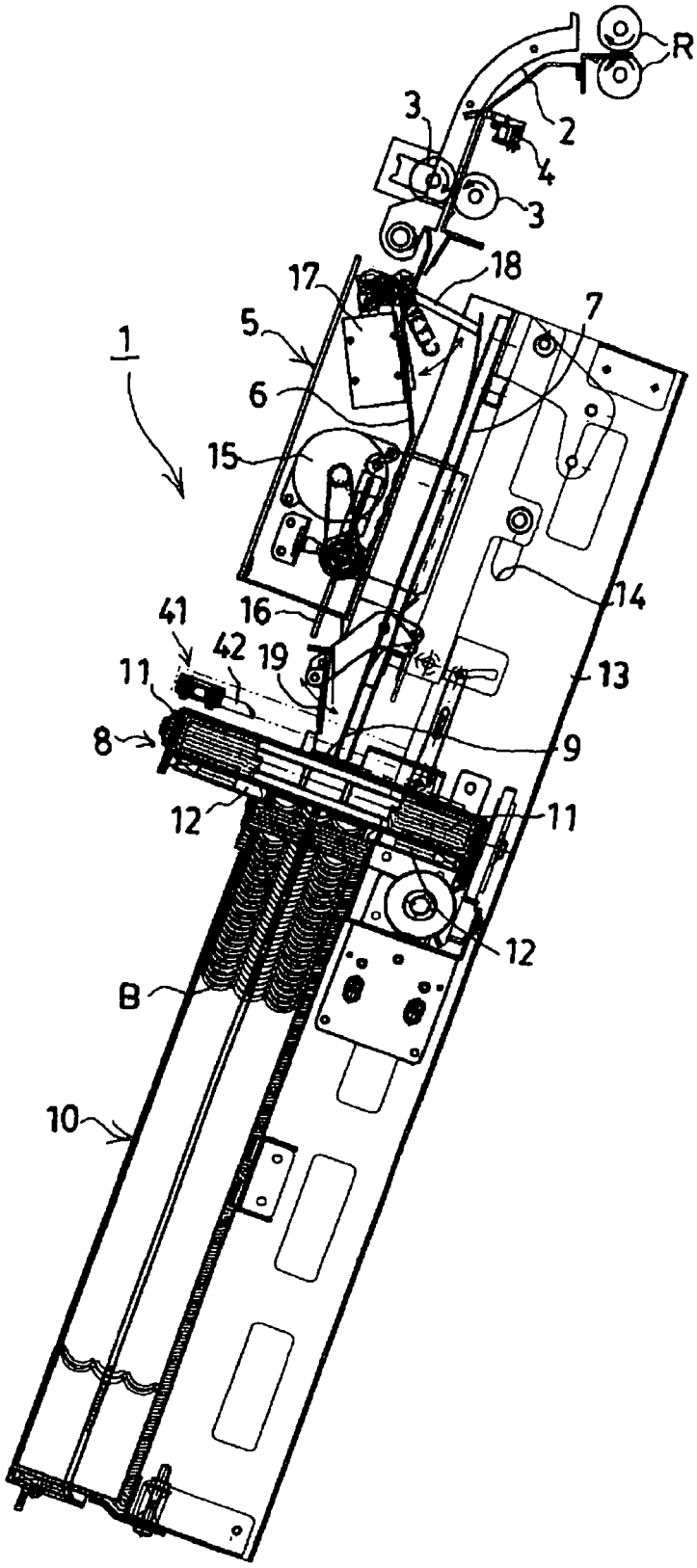
FIG. 1 is a side view of a bind processing apparatus showing an embodiment of the invention.

1 . . . bind processing apparatus
3 . . . sheet feeding roller
4 . . . sheet detecting sensor
5 . . . sheet guide unit
6 . . . sheet guide
7 . . . sheet table
8 . . . bind mechanism portion
9 . . . sheet front end position restricting plate
10 . . . binder cartridge
16 . . . rotational type feed flap
18 . . . sheet hold flap
19 . . . sheet clamp
22 . . . rubber piece
23 . . . low friction resin film
31 . . . positioning pusher
32 . . . slide guide shaft
33 . . . gear
34 . . . crank pin
35 . . . cam groove
36 . . . stepping motor
41 . . . punch hole aligning mechanism
42 . . . punch hole aligning pin
43 . . . slide guide
44 . . . motor
45 . . . lever
46 . . . link
47 . . . photointerrupter (upper)
48 . . . photointerrupter (lower)

BEST MODE FOR CARRYING OUT THE INVENTION

Embodiments of the invention will be explained in reference to the drawings as follows.

Embodiment 1

Figure 2:
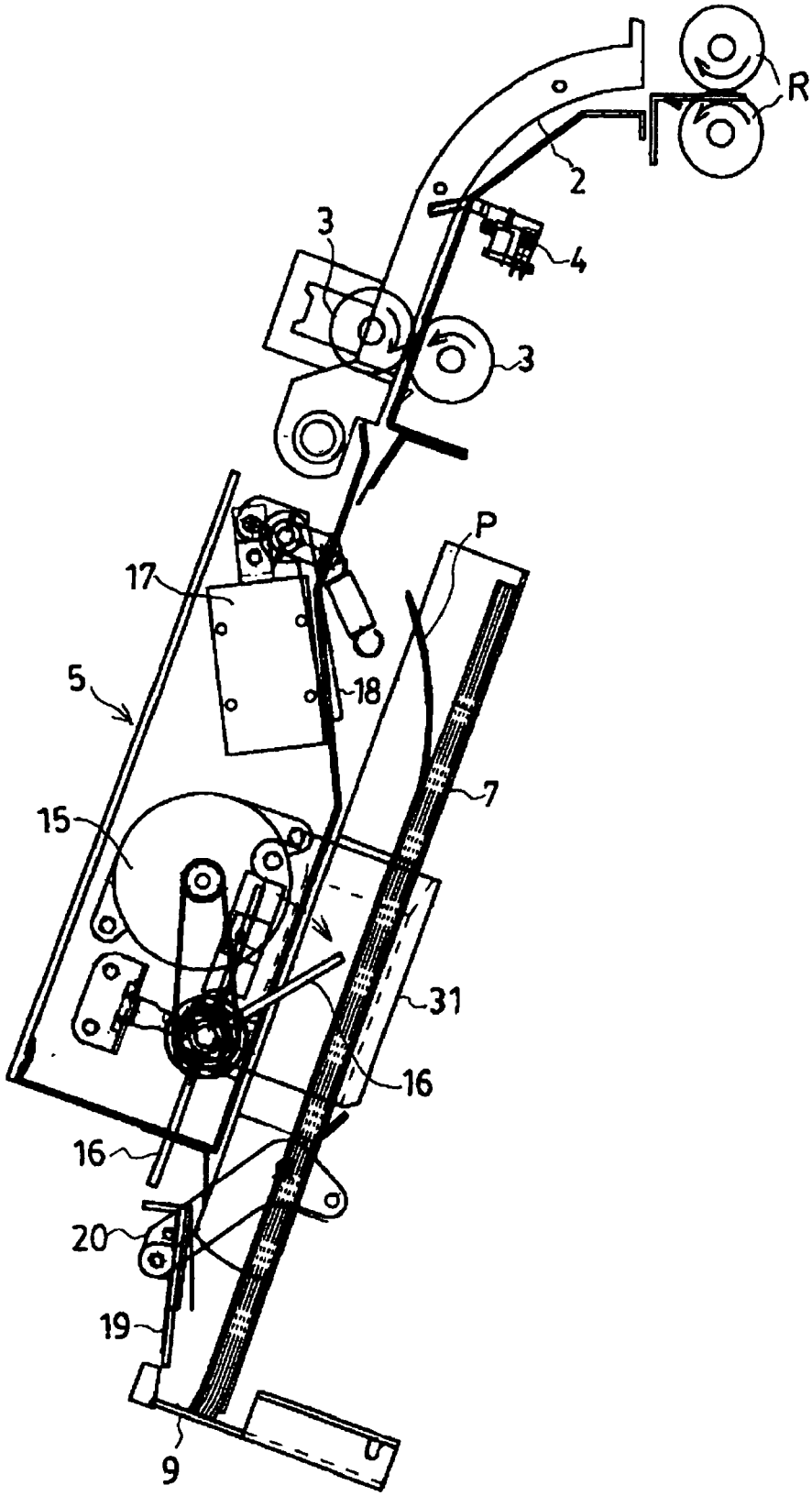
FIG. 2 is a view enlarging a portion of FIG. 1.

FIG. 1 and FIG. 2 show a bind processing apparatus 1 for mounting a ring binder to sheets attached with punch holes to bind as an example of a sheet postprocessing apparatus. A roller R shown at a topmost portion in FIG. 1 is a sheet discharging roller of a copier, a punching apparatus or the like at a prestage, and a sheet fed by the sheet discharging roller R is moved down in a skewed lower direction along a sheet guide 2 to reach a sheet feeding roller 3. A sheet detecting sensor 4 is arranged immediately before the sheet feeding roller 3, and 1 cycle of a binding processing comprising sheet aligning and binder mounting is carried out from when the sheet detecting sensor 4 detects the sheet. The sheet drawn by the sheet feeding roller 3 is dropped by its own weight by being guided onto a sheet table 7 by a sheet guide 6 at inside of a sheet guide unit 5, and is brought into contact with a sheet front end position restricting plate 9 of a front face (an upper face in the drawing) of a bind mechanism portion 8 arranged on a lower side of the sheet table 7.

A punch hole aligning mechanism 41 is provided slightly upstream from the sheet front end position restricting plate 9. The punch hole aligning mechanism 41 moves down a punch hole aligning pin 42 along a slide guide 43 (refer to FIG. 11) and penetrates the punch hole aligning pin 42 through the punch hole of the sheet P attached with the punch holes on the sheet table to align the sheets attached with the punch holes by a reference of the punch hole.

A back face of the bind mechanism portion 8 is connected with a binder cartridge 10, inside of the binder cartridge 10 is charged with a ring binder B in a shape of dividing a ring in three, in a state of being laminated in an up and down direction, and the ring binder B is pushed up to an upper side by a spring and a pusher (not illustrated) at inside of the binder cartridge 10. The bind mechanism portion 8 is provided with respective up and down pairs of pushers 11 and slide type separators 12, and a frontmost row of the ring binder B is separated from a successive row of the ring binder by closing the up and down separators 12.

One set of sheets subjected to a punch processing are fed onto the sheet table 7, and subjected to a sheet aligning processing, mentioned later, thereafter, the sheet front end position restricting plate 9 is moved down by a motor (not illustrated) to escape from a front face of the bind mechanism portion 8, the sheet table 7 is driven to move forward along a guide groove 14 of the frame 13, and a lower end face of the sheets P on the sheet table 7 is brought into contact with a front face of a binder cartridge 10. At this occasion, punch holes of the sheets are brought to between up and down pushers 11, the up and down pushers 11 are driven to close a ring portion of the ring binder B, and a recessed portion and a projected portion of front ends of the ring portion opposed to each other are fitted together at inside of the punch hole of the sheets to be fixed in a ring-like shape to bind the sheets P. Further, after the binding processing, the sheets P are discharged by swinging a lower portion of the sheet table 7 to an upper side by constituting a fulcrum by an upper portion thereof although illustration thereof is omitted.

Figure 3:
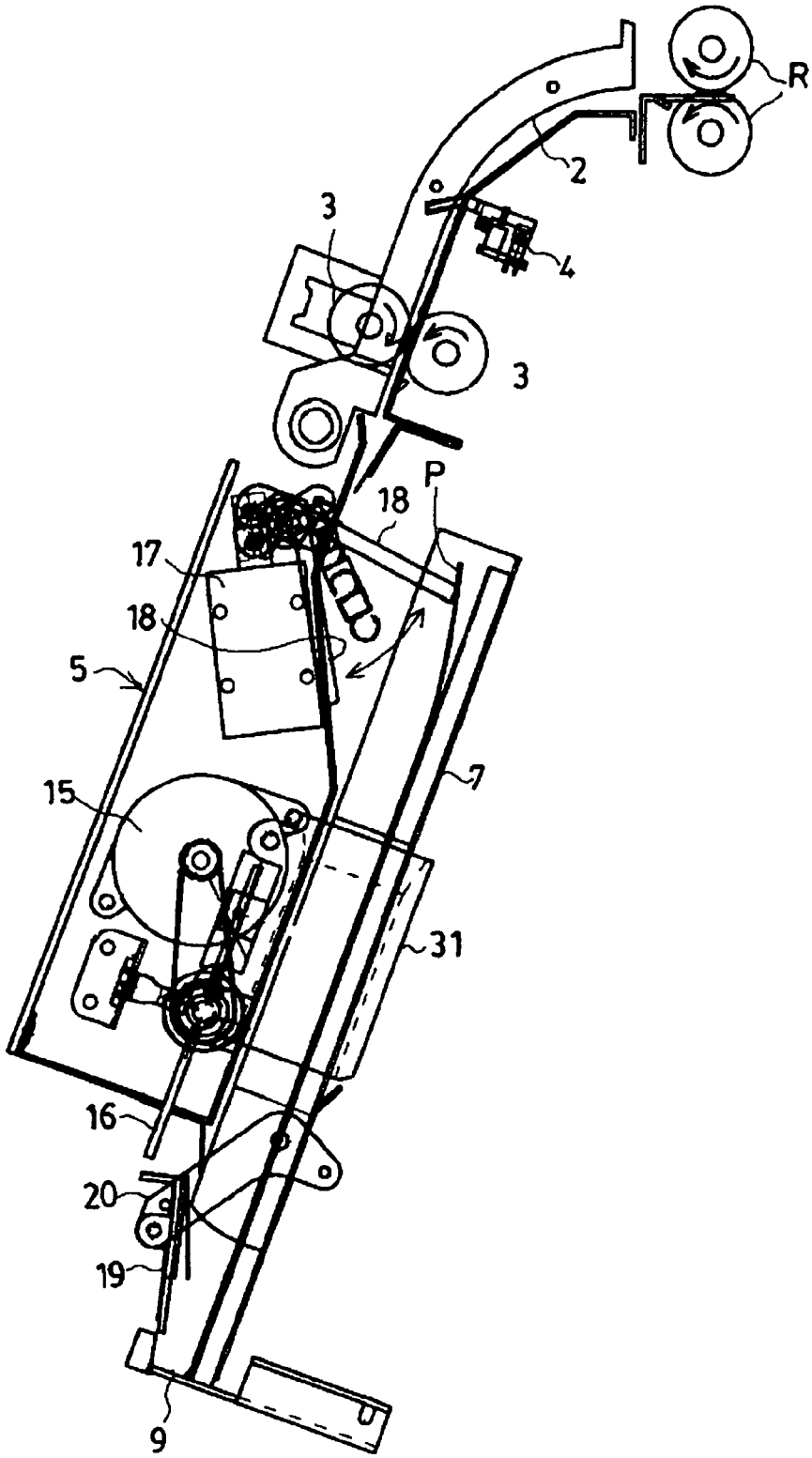
FIG. 3 is a view enlarging a portion of FIG. 1.

FIG. 2 and FIG. 3 are views enlarging a portion of FIG. 1, a lower portion of inside of the sheet guide unit 5 of an opening/closing type arranged on the sheet table 7 is provided with a soft rotational type feed flap 16 for sweeping the sheet P to a lower side by being driven to rotate by a motor 15. An upper side of the rotational feed flap 16 is provided with a sheet hold flap 18 for pressing a rear end portion of the sheet P to the sheet table 7 by being rotated by a solenoid 17. The rotational type feed flap 16 is rotated by one rotation or a half rotation to rub an upper face of the sheets P to a front side at each time of feeding the sheet to bring the sheet P into contact with the sheet front end position restricting plate 9. The sheet hold flap 18 on an upstream side thereof carries out a reciprocating operation for moving down and moving up relative to the sheet table 7 and presses the rear portion of the sheet P to the sheet table 7 to thereby prevent the sheet from floating up as shown by FIG. 3. A sheet clamp 19 is provided at a front portion (lower portion in the drawing) of the sheet table 7, the sheet is moved down and moved up relative to the sheet table 7 by a link mechanism (not illustrated) to clamp the sheet on the sheet table 7.

Figure 4:
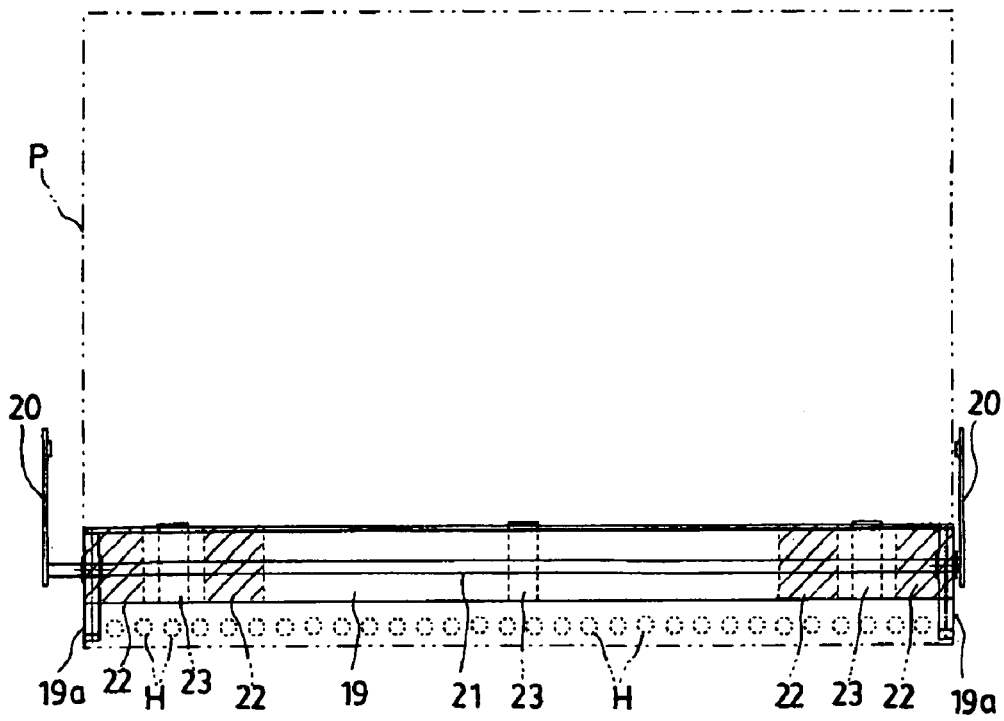
FIG. 4 is a plane view of a sheet clamp.
Figure 5:
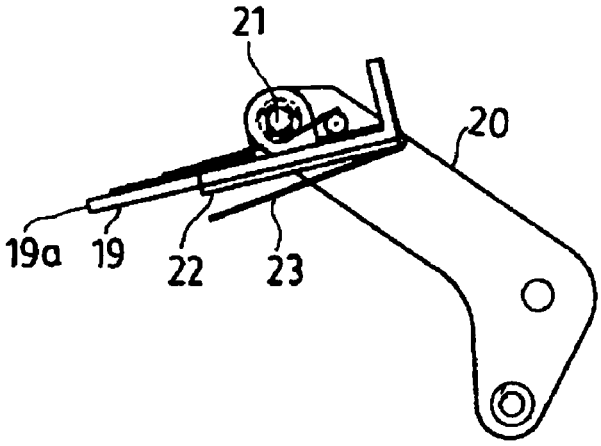
FIG. 5 is a side view of the sheet clamp.

FIG. 4 and FIG. 5 show a sheet clamp mechanism, levers 20 arranged on both left and right sides of the sheet table 7 are connected by a shaft 21, and the sheet clamp 19 extended over an entire width of the sheet table 7 are pivotably attached to the shaft 21. Both end portions 19*a* of the sheet clamp 19 are projected frontward from other portion (downward therefrom in FIG. 4) and extended to vicinities of the sheet front end position restricting plate 9 shown in FIG. 1, guide the front end of the sheet fed from the upper side so as not to ride over the sheet front end position restricting plate 9 to be deviated therefrom, and prevent a portion other than the two left and right end portions 19*a* from closing punch holes H of the punched sheet P on the sheet table.

Both left and right end portions of a back face of the sheet clamp 19 are pasted with respective two pieces of rubber pieces 22, and low friction resin films 23 of Mylar films or the like are arranged between the respective left and right pairs of the rubber pieces 22 and a center thereof. One end of the low friction resin film 23 is adhered to an upstream side edge portion of the sheet clamp 19, an end portion thereof on a downstream side is hung down, and when the front end of the sheet is brought into contact with the low friction resin film 23, the front end is guided on the sheet table 7 along the low friction resin film 23.

Figure 6:
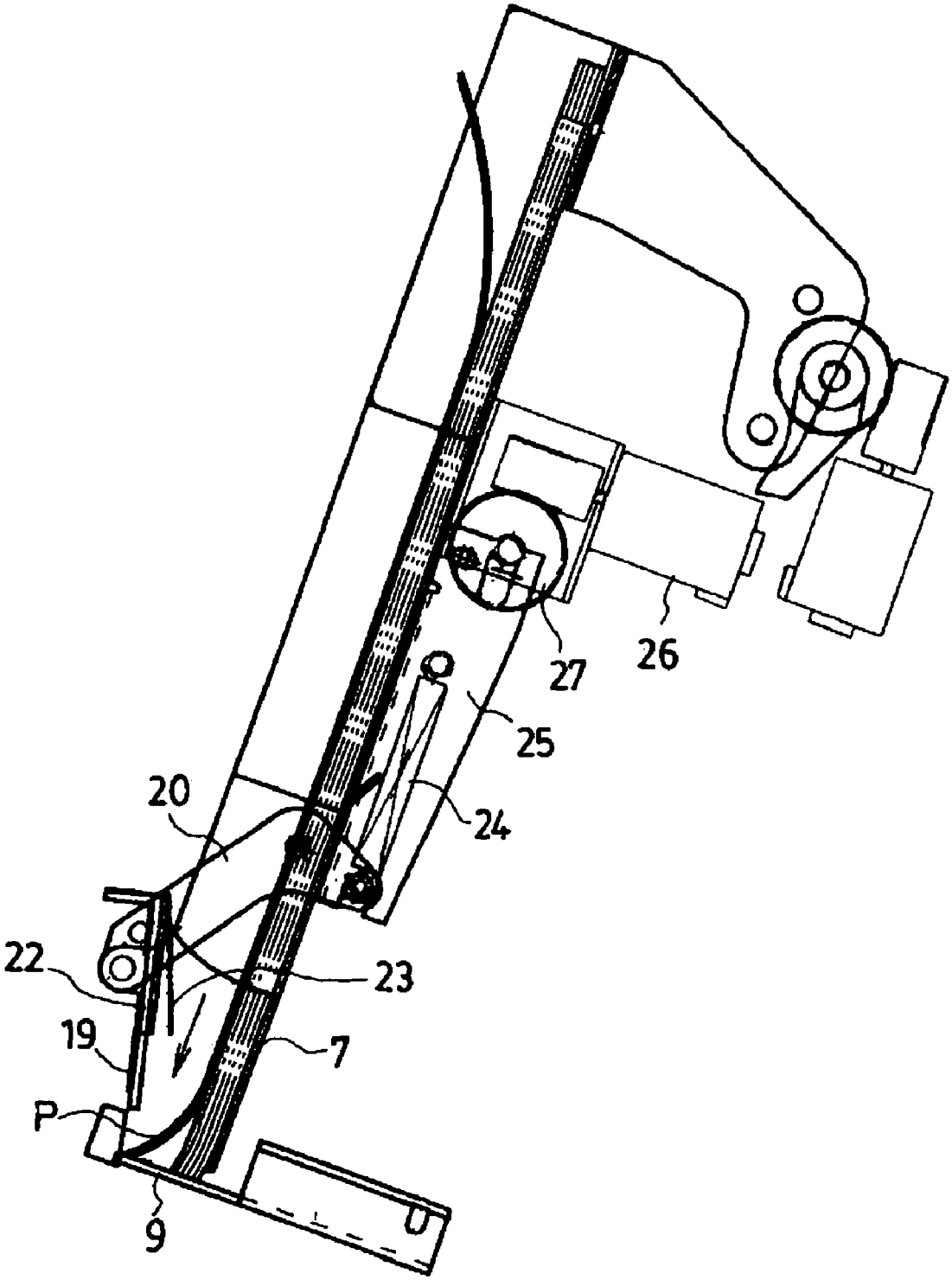
FIG. 6 is a side view of a sheet table and a sheet clamp mechanism.
Figure 7:
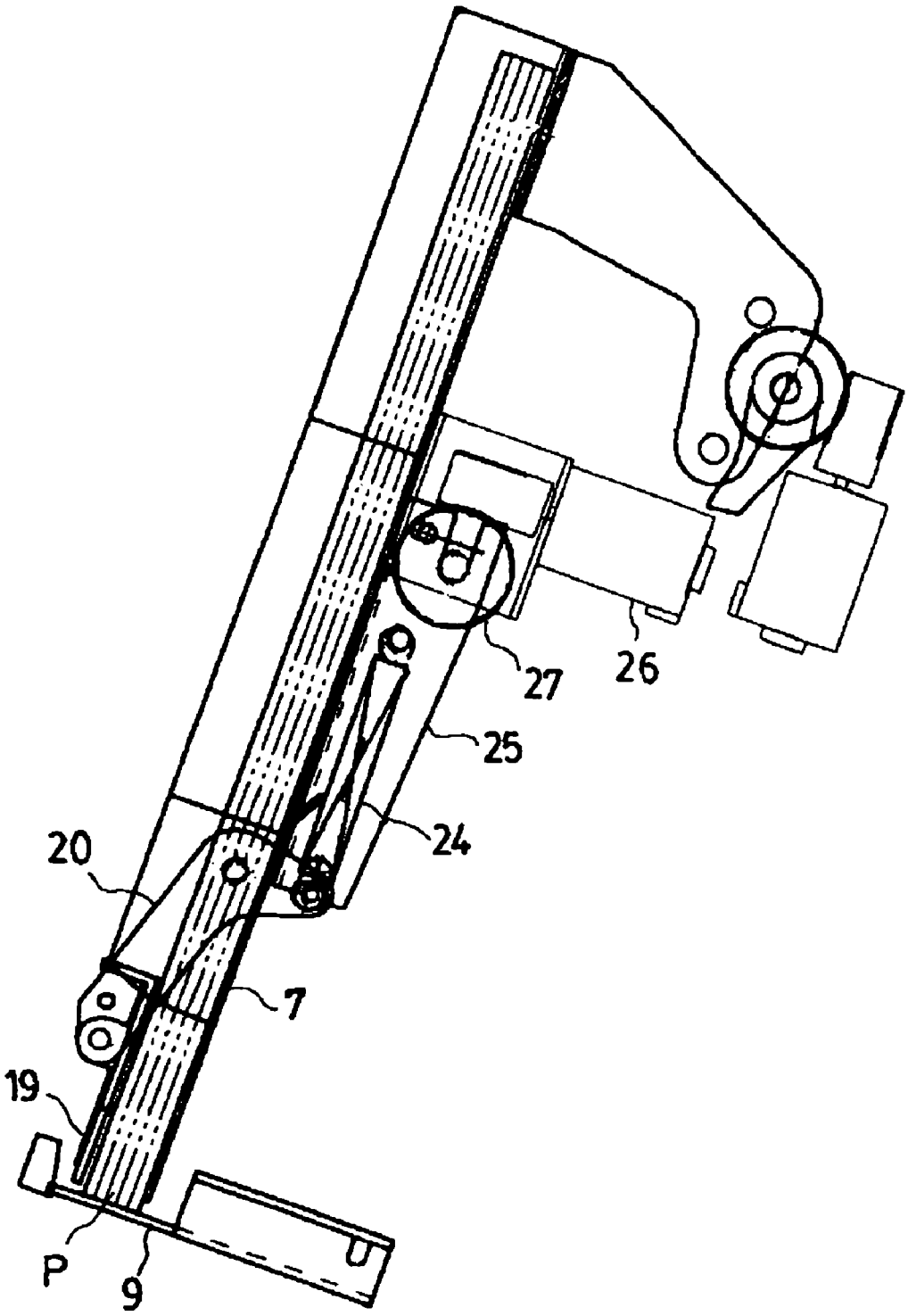
FIG. 7 is a side view of the sheet table and the sheet clamp mechanism.

FIG. 6 shows an open state of moving up the sheet clamp 19, FIG. 7 shows a clamp state of moving down the sheet clamp 19. The lever 20 for supporting the sheet clamp 19 is connected to a link 25 by way of a tension coil spring 24, the link 25 is connected to a crankshaft 27 driven by a motor 26, and the sheet clamp 19 is moved up or moved down relative to the sheet table 7 in accordance with a direction of rotating the motor 26 and the crankshaft 27.

Since the tension coil spring 24 is interposed between the lever 20 and the link 25, regardless of a thickness of the sheets P on the sheet table 7, the sheet clamp 19 can be brought into press contact with the sheets P. When the sheet clamp 19 is moved down, the rubber piece 22 is brought into press contact with the sheet to hold the sheet, since the low friction resin film 23 provided to be aligned with the rubber piece 22 is thinner than the rubber piece 22, the low friction resin film 23 does not hinder the rubber piece 22 from being brought into press contact with the sheet.

Figure 8:
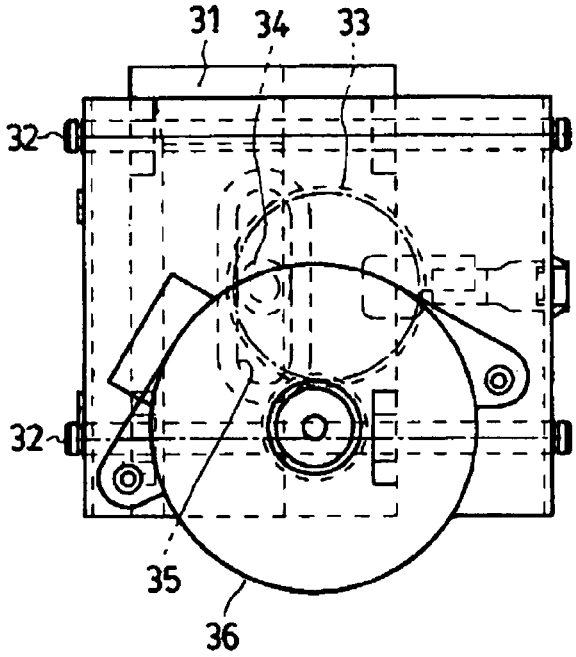
FIG. 8 is a plane view of a positioning pusher.
Figure 9:
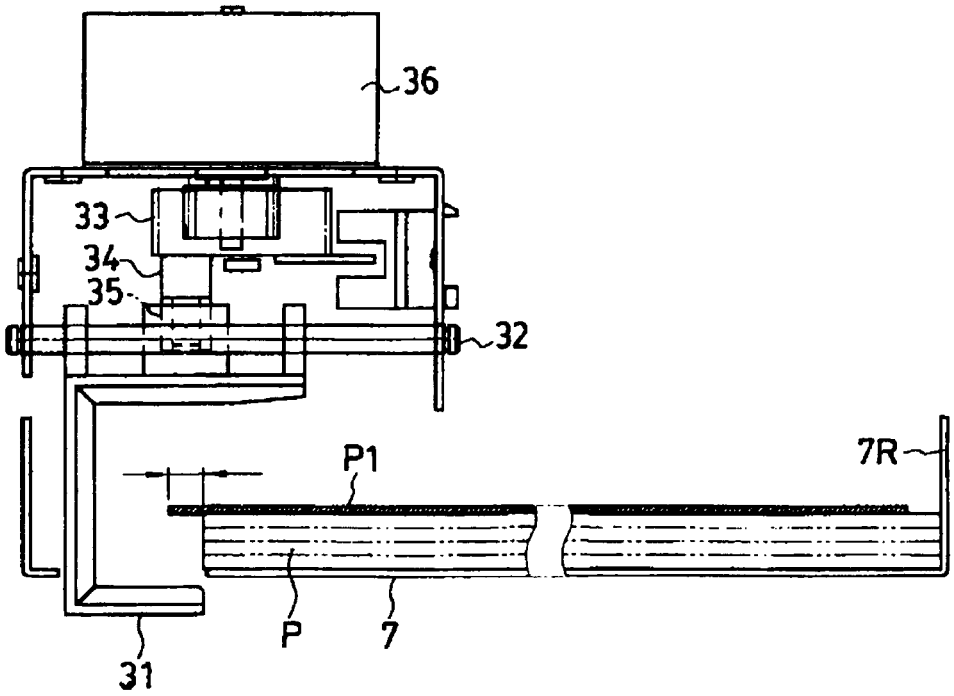
FIG. 9 is a front view of the positioning pusher.

FIG. 8 and FIG. 9 show a sheet aligning mechanism for aligning a position in a direction orthogonal to a sheet carrying direction, and the sheet is positioned in a transverse direction by a positioning pusher 31 arranged at a side of the sheet table 7. The positioning pusher 31 is mounted to a slide guide shaft 32, a crank pin 34 provided at a gear 33 is engaged with a linear cam groove 35 formed at an upper portion of the positioning pusher 31, and by driving the gear 33 by a stepping motor 36, the positioning pusher 31 is reciprocally moved between an initial position on a left end and a sheet aligning position on a right side in accordance with a direction of rotating the stepping motor 36. An interval between the positioning pusher 31 at the sheet aligning position and a right side wall face 7R of the sheet table 7 is controlled to coincide with a width dimension of the sheet P.

Figure 10:
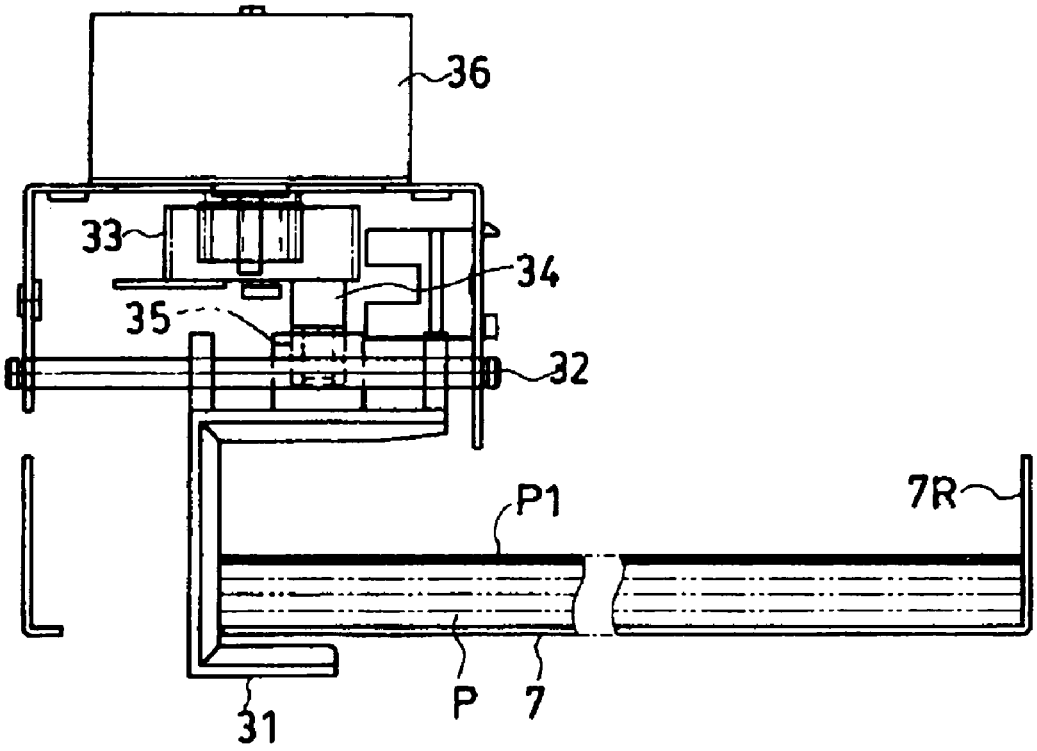
FIG. 10 is a front view of the positioning pusher.

FIG. 9 shows a case in which a sheet P1 fed onto the sheet table 7 is shifted transversely, and by sliding the positioning pusher 31 to the sheet aligning position after introducing the sheet to push the sheet P1 to the right side wall face 7R of the sheet table 7 as shown by FIG. 10, the position of the sheet P1 in the transverse direction is corrected, and after aligning the sheet, the positioning pusher 31 returns to a left standby position.

FIG. 11 through FIG. 14 show the punch hole aligning mechanism 41, the punch hole aligning pin 42 engaged with the slide guide 43 and a lever 45 driven by a motor 44 are connected by a link 46, and the punch hole aligning pin 42 is moved up and down between an upper initial position and a lower sheet penetrating position in accordance with a direction of pivoting the lever 45. Upper and lower sides of the lever 45 are arranged with photointerrupters 47, 48 or reflection type photo sensors 47, 48 as a first and a second optical sensor, when the punch hole aligning pin 42 is disposed at the upper initial position, an optical path of the upper side photointerrupter 47 is blocked by the lever 45, when the punch hole aligning pin 42 is moved down to the sheet penetrating position, an optical path of the lower side photointerrupter 48 is blocked by the lever 45 to thereby detect a position of the punch hole aligning pin 42. That is, the first and the second optical sensors 47, 48 are functioned as sheet penetration detecting apparatus. A control portion controls a punch hole aligning operation, mentioned later, based on signals of the upper and the lower photointerrupters 47, 48 and a count value of a timer (counter) at inside of the control portion.

A front end of the punch hole aligning pin 42 is constituted by a taper shape and can be inserted into the punch hole even when a position of the punch hole of the bundle of sheets is unaligned to provide a wedge action of correcting the position of the unaligned punch hole owing to the taper shape. The one or more of the punch hole aligning pins 42 are respectively arranged at vicinities of left and right end portions of the sheets. Distances between a center of each punch hole aligning pin 42 and the sheet front end position restricting plate 9 and a right side wall face of the sheet table 7 are respectively slightly longer than distances between a center of the punch hole of the sheets attached with the punch holes and a front end of the sheet and a side end of the sheet to thereby prevent a movement of the sheet on a plane owing to an error of the position of the punch hole from being hindered in the punch hole aligning operation.

Next, operation of the punch hole aligning mechanism 41 will be explained. When the sheets attached with the punch holes are successively supplied to the bind processing apparatus 1, feeding by the rotational type feed flap 16, sheet aligning by an outer shape reference by the positioning pusher 31, and sheet holding by the sheet hold flap 18 are carried out for respective sheets, when one set of the sheets are finished to supply, sheet aligning by a punch hole reference is carried out by the punch hole aligning mechanism 41.

Figure 11:
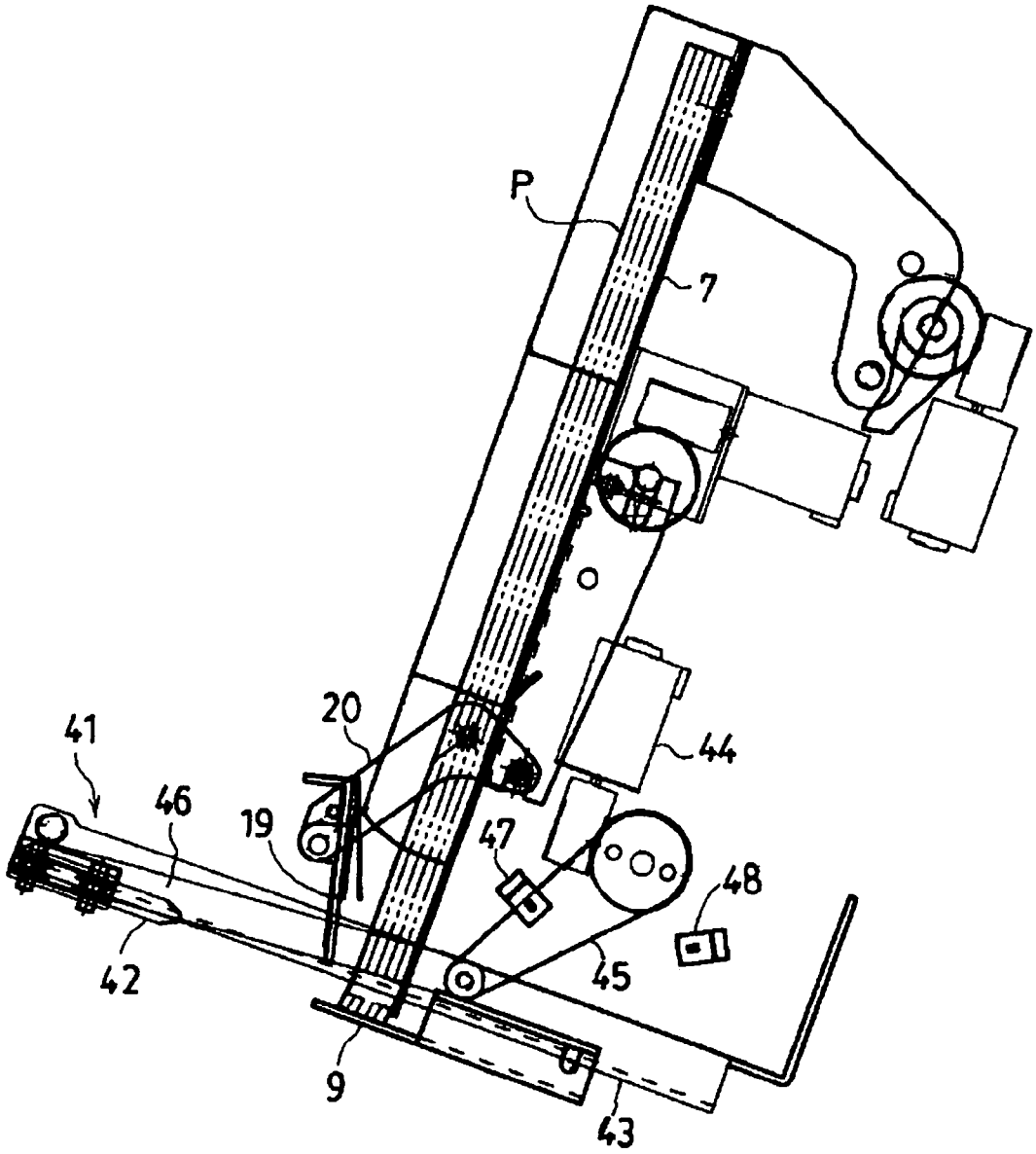
FIG. 11 is a side view of a punch hole aligning mechanism.
Figure 15:
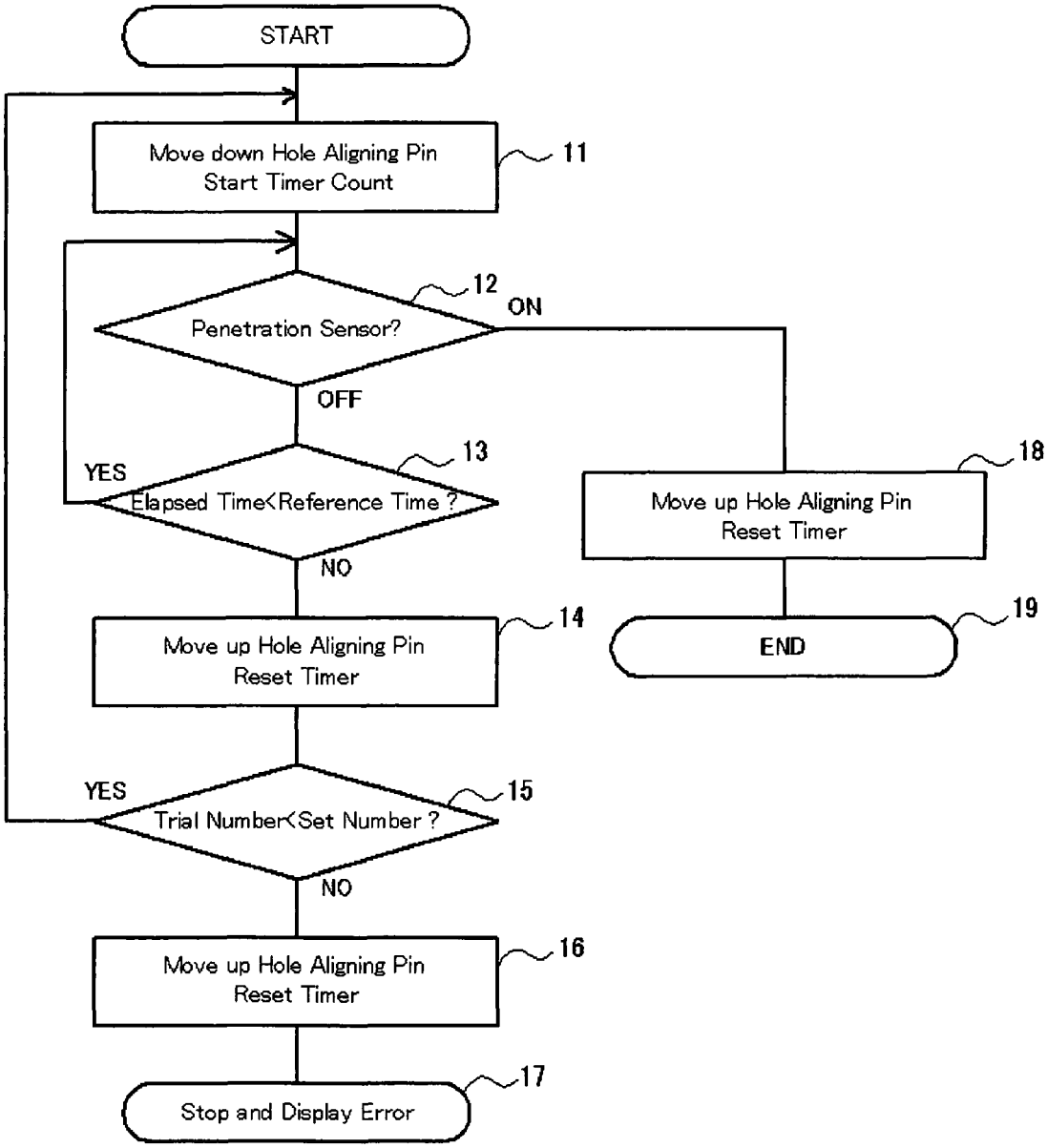
FIG. 15 is a flowchart of operation of the punch hole aligning mechanism.

FIG. 15 shows a control flow of the punch hole aligning mechanism 41, in starting, simultaneously with driving to move down the punch hole aligning pin 42 from an initial state shown in FIG. 11, the counter of the control portion starts counting time (step 11). The counter is set with a reference time period constituted by adding a certain degree of allowance to a time period required for the punch hole aligning pin 42 to reach the penetrating position from the initial position in a normal hole aligning operation.

Figure 12:
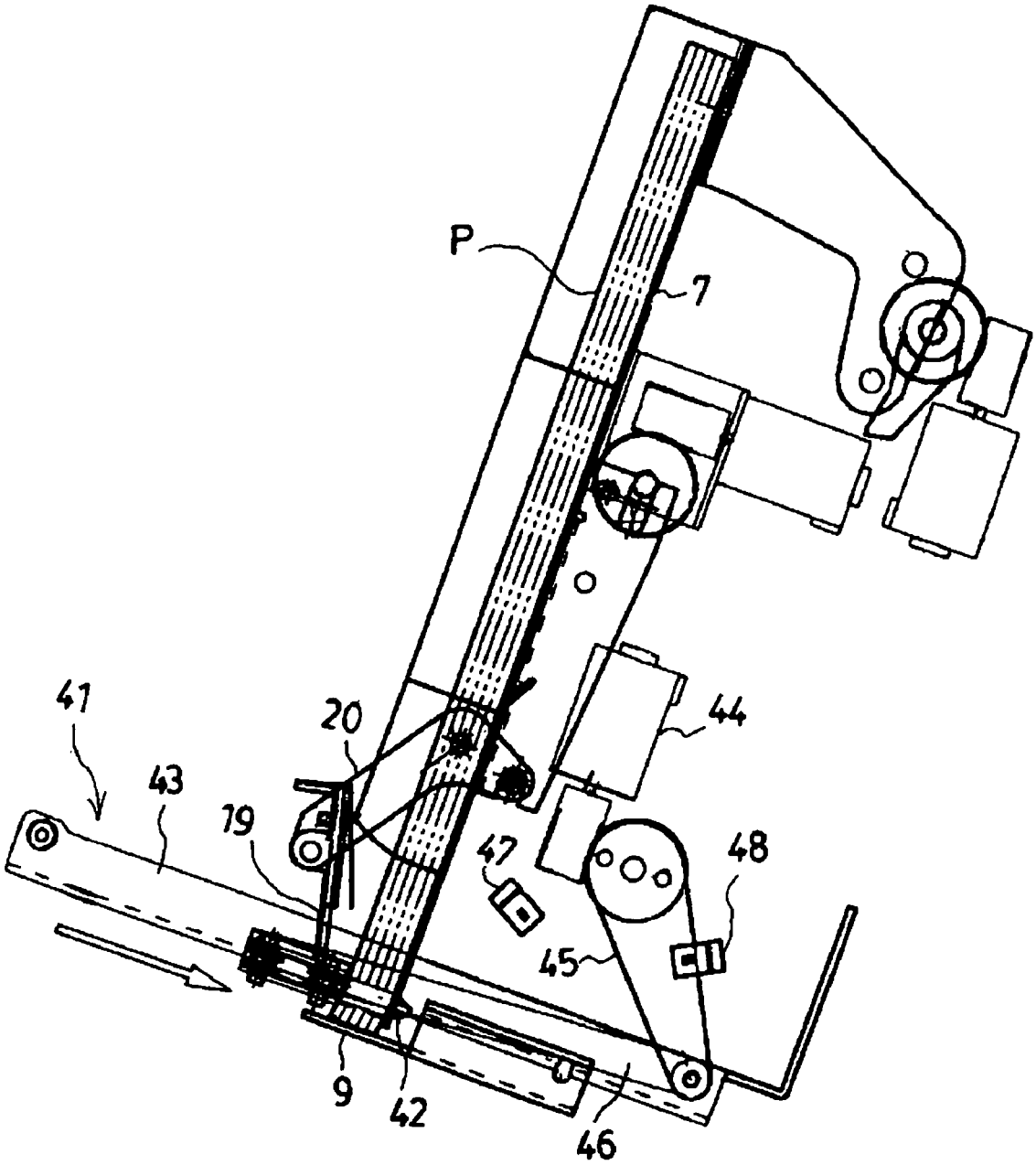
FIG. 12 is a side view of the punch hole aligning mechanism.
Figure 13:
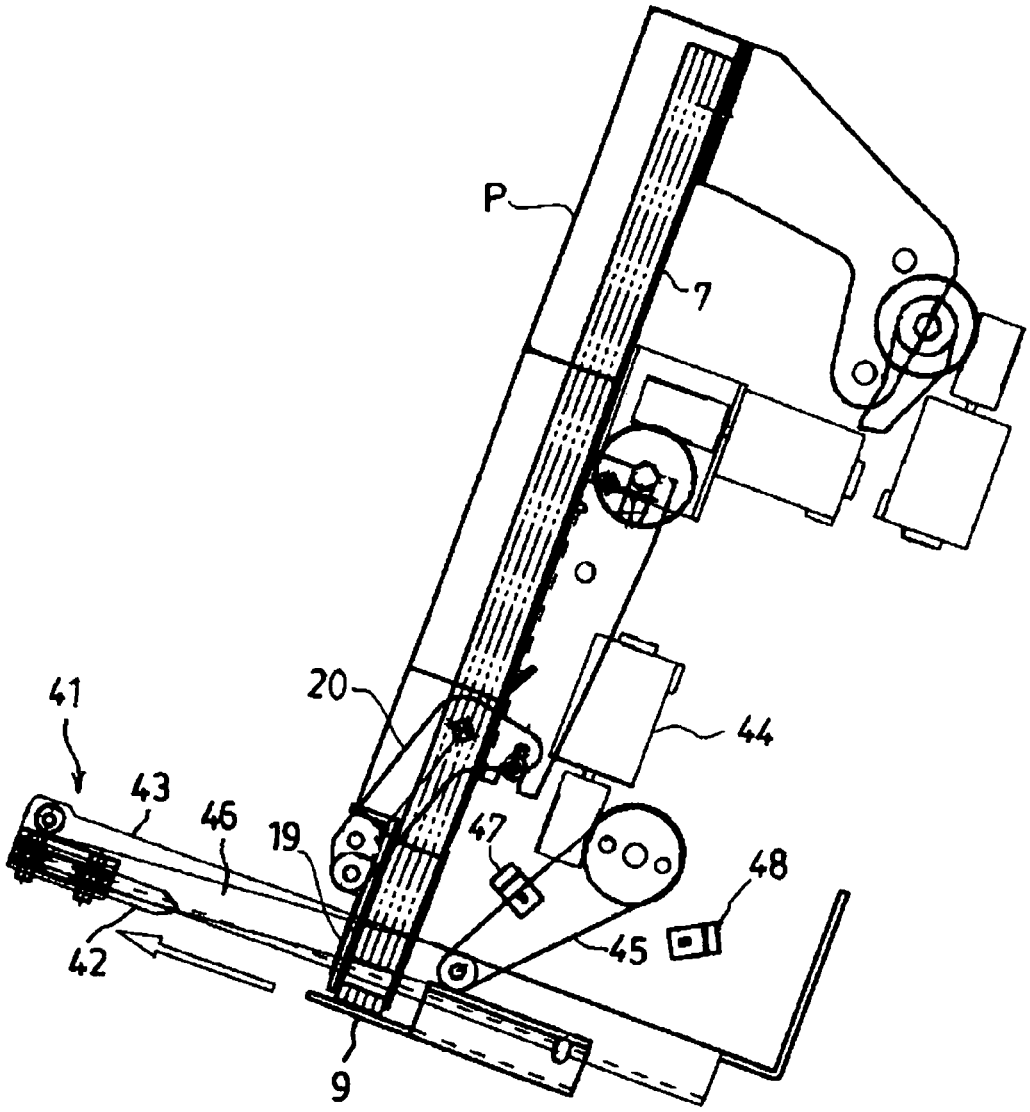
FIG. 13 is a side view of the punch hole aligning mechanism.

The control portion monitors a penetration signal by the penetration sensor (lower side photointerrupter 48) in counting time (step 12), and continues counting time (step 13) and driving to move down the punch hole aligning pin 42. When the punch hole aligning pin 42 reaches the penetrating position to acquire the signal from the lower side photointerrupter 48 as shown by FIG. 12 within the reference time period, the operation proceeds from step 12 to step 18, and moves up the punch hole aligning pin 42 to the initial position to thereby normally finish 1 cycle of the punch hole aligning operation (step 19) as shown by FIG. 13. Further, the sheet clamp 19 is moved down simultaneously with moving up the pin or therebefore to clamp the sheet bundle P aligned by the punch hole reference.

Figure 14:
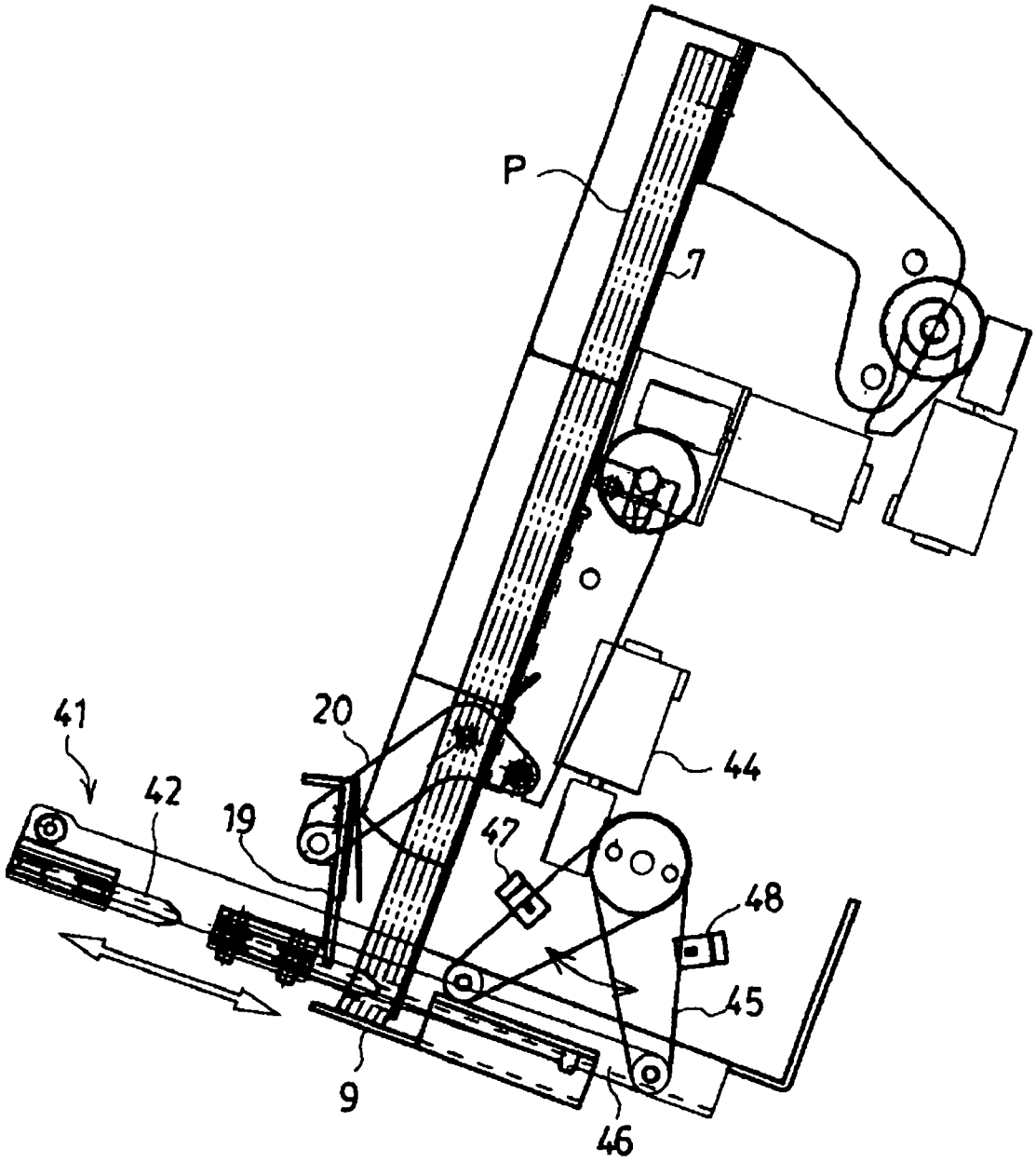
FIG. 14 is a side view of the punch hole aligning mechanism.

On the other hand, when the punch hole aligning pin 42 is stopped in the midst of moving down as shown by FIG. 14 and the timer counter counts up the reference time period by an unalignment of the punch hole of the sheet bundle P after driving to move down the punch hole aligning pin 42, the operation proceeds from step 13 to step 14 to return the punch hole aligning pin 42 to the initial position and reset the timer counter. Further, in the hole aligning operation at a first time, the operation returns from step 15 to step 11 to start the punch hole aligning operation at a second time.

Even when the sheets are not penetrated by the punch hole aligning pin 42 by the hole aligning operation at the first time, in most cases the sheets are penetrated by the punch hole aligning pin 42 by the punch hole aligning operation at the second time by correcting the positional shift of the sheet bundle to some degree by an aligning operation provided by the shape of the front end of the punch hole aligning pin 42 as described above, in this case, when the punch hole is penetrated after a retrial, the operation proceeds from step 12 to step 18 to be finished normally (step 19).

When the sheets are not penetrated by the punch hole aligning pin 42 at a final time of a predetermined number of times of trial (for example, twice), the operation proceeds from step 15 to step 16 to return the punch hole aligning pin 42 to the initial position (step 16), stops the operation thereafter and displays an error on a display board or emits alarm sound (step 17). Further, when there is constructed a constitution of discharging the sheet by proceeding to a sheet discharge mode along with display of the error, time and labor of removing a failed sheet bundle can be saved.

Further, there may be constructed a constitution in which a punch hole detecting sensor of an optical type or the like is arranged on the sheet table or a sheet supply path, presence/absence of the punch hole of the sheet is detected by the punch hole detecting sensor, when there is present a sheet without a punch hole, the aligning operation by the punch hole aligning pin 42 is prevented from being carried out, and when the positional shift of the punch hole of the sheet bundle on the sheet table is considerable and it is recognized that the pin cannot be penetrated therethrough, the aligning operation is not carried out.

Further, the invention is not limited to the above-described embodiment but can variously be modified or changed within a technical range of the invention and it is natural that the invention covers the modifications or changes.

The application is based on Japanese Patent Application (Japanese Patent Application No. 2004-235639) filed on Aug. 12, 2004 and contents of which are incorporated herein by reference.

INDUSTRIAL APPLICABILITY

In accordance with one or more embodiments of the invention, according to the sheet postprocessing apparatus and the sheet postprocessing method, when the pin cannot be penetrated through the punch hole within the reference time period in aligning the sheet by penetrating the pin into the punch hole of the sheets attached with the punch holes, the pin is returned to the initial position and the penetrating operation is tried again. Even when the degree of unalignment of the punch hole is considerable and the pin cannot be penetrated therethrough by once, the pin can be finally penetrated therethrough frequently by several times of trials and therefore, an error in aligning the sheet is reduced.

Further, the position of the punch hole is aligned gradually by repeating the penetrating operation until the pin penetrates through the punch hole and therefore, the object can be achieved by a pin drive force to a degree by which there is not a concern of deforming or destructing the punch hole by the pin, it is not necessary to constitute a motor, a solenoid or the like by a large size, and large-sized formation of the apparatus and an increase in cost are not brought about.

According to the sheet postprocessing apparatus of aligning the sheets by the reference of the punch holes by penetrating the pin through the punch hole of the sheet taken in onto the sheet table, there is provided means for detecting penetration of the sheet by the pin, and there is provided means for measuring the pin drive time period to be compared with the reference time period, and controlling to retry the penetrating operation by returning the pin to the initial position when the pin drive time period reaches the reference time period before penetrating the sheets, that is, when the pin cannot penetrate through the punch hole within the reference time period. Thereby, even when the degree of unalignment of the punch hole is considerable and the pin cannot be penetrated therethrough by once, the pin is frequently penetrated therethrough finally and therefore, the error in aligning the sheets can be reduced.

The invention claimed is:

1. A sheet postprocessing apparatus comprising:

a sheet table;

a pin capable of penetrating through a punch hole of a sheet taken in onto the sheet table;

a sheet penetration detecting apparatus for detecting penetration of the pin through the sheet; and a counter for measuring a time period of driving the pin.

2. The sheet postprocessing apparatus according to claim 1, further comprising:

a control portion for retrying a penetrating operation by returning the pin to an initial position when the time period of driving the pin reaches a reference time period for penetrating through the sheet.

3. The sheet postprocessing apparatus according to claim 2, further comprising:

a pivotable lever;

wherein the pin is moved between an initial position and a sheet penetrating position in accordance with pivoting the lever;

the sheet penetration detecting apparatus comprises a first optical sensor and a second optical sensor;

when the pin is disposed at the initial position, the lever blocks an optical path of the first optical sensor; and when the pin is disposed at the sheet penetrating position, the lever blocks an optical path of the second optical sensor.

4. The sheet postprocessing apparatus according to claim 2, further comprising:

a trial number of times setting portion for setting a trial number of times of the pin;

wherein the control portion returns the pin to the initial position and displays an error when the trial number of times reaches a set number of times and when the time period of driving the pin reaches the reference time period before penetrating the sheet in a final trial.

5. The sheet postprocessing apparatus according to claim 4, further comprising:

controlling means for proceeding to a sheet discharge mode without carrying out a postprocessing of a bind processing by a staple, a binder mounting processing or the like at the time of the error.

6. The sheet postprocessing apparatus according to claim 1, further comprising:

a pivotable lever;

wherein the pin is moved between an initial position and a sheet penetrating position in accordance with pivoting the lever;

the sheet penetration detecting apparatus comprises a first optical sensor and a second optical sensor;

when the pin is disposed at the initial position, the lever blocks an optical path of the first optical sensor; and when the pin is disposed at the sheet penetrating position, the lever blocks an optical path of the second optical sensor.

7. The sheet postprocessing apparatus according to claim 1, further comprising:

a binder mounting processing apparatus.

8. A sheet postprocessing method comprising:

taking in a sheet formed with a punch hole for binding onto a sheet table sheet by sheet;

loading one set of the sheets onto the sheet table;

driving a pin to a punch hole of the sheet taken in onto the sheet table;

measuring a time period of driving the pin;

comparing the time period of driving the pin with a reference time period;

retrying a penetrating operation by returning the pin to an initial position when the time period of driving the pin reaches the reference time period for penetrating the sheet;

penetrating the pin to the punch hole of the sheet taken in onto the sheet table; and aligning the sheets by a reference of the punch hole.

9. The sheet postprocessing method according to claim 8, further comprising the step of:

carrying out binder mounting processing.

10. The sheet postprocessing method according to claim 8, further comprising the steps of:

measuring a trial number of times of the pin; and displaying an error when the trial number of times reaches a predetermined number of times and when the time period of driving the pin reaches the reference time period before penetrating the sheet in a final trial.

* * * * *